US006924499B2

(12) United States Patent
Poisel et al.

(10) Patent No.: US 6,924,499 B2
(45) Date of Patent: Aug. 2, 2005

(54) DEVICE FOR DETECTING DEPOSITS ON SURFACES, IN PARTICULAR, IN WASHING MACHINES AND/OR DISHWASHERS

(75) Inventors: Hans Poisel, Leinburg (DE); Josef Weber, Chamerau (DE); Rüdiger Eiermann, Staufen (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 150 days.

(21) Appl. No.: 09/922,464

(22) Filed: Aug. 3, 2001

(65) Prior Publication Data

US 2002/0066873 A1 Jun. 6, 2002

Related U.S. Application Data

(63) Continuation of application No. PCT/EP00/00874, filed on Feb. 3, 2000.

(30) Foreign Application Priority Data

Feb. 3, 1999 (DE) ..... 199 04 280

(51) Int. Cl.[7] ..... G01N 15/06
(52) U.S. Cl. ..... 250/574; 8/158; 68/12.02
(58) Field of Search ..... 210/86, 96.1, 96.2, 210/103, 104; 8/158; 68/12.02; 250/559.45, 559.42, 227.11, 227.14, 573–577; 356/436–439

(56) References Cited

U.S. PATENT DOCUMENTS 4,159,420 A * 6/1979 Tsunoda ..... 250/227.25
4,342,919 A * 8/1982 Brogardh ..... 250/577
4,946,242 A * 8/1990 Tanno et al. ..... 250/227.11
5,804,817 A * 9/1998 Seiler et al. ..... 250/227.25
6,035,471 A * 3/2000 Lahrmann et al. ..... 8/158
6,084,519 A * 7/2000 Coulling et al. ..... 250/574
6,173,609 B1 * 1/2001 Modlin et al. ..... 250/577
6,232,603 B1 * 5/2001 Nelson ..... 250/227.25

FOREIGN PATENT DOCUMENTS

| | | |
|---|---|---|
| DE | 34 54 100 | 4/1975 |
| DE | 41 02 146 C1 | 9/1991 |
| DE | 43 30 710 C1 | 11/1994 |
| DE | 33 03 221 A1 | 1/1995 |
| DE | 1977 14 664 C2 | 11/2002 |
| GB | 1 484 613 | 9/1977 |

* cited by examiner

*Primary Examiner*—Thanh X. Luu
(74) *Attorney, Agent, or Firm*—John T. Wonburn; Russell W. Warnock; Craig J. Loest

(57) ABSTRACT

A device and a method for detecting deposits on surfaces includes a body having a surface on which deposits occur and influence reflection properties of the surface to electromagnetic radiation. A transmitter transmits electromagnetic radiation to the body and a detector detects the presence of the deposits at the surface. The detector measures electromagnetic radiation received from the transmitter after reflection at the surface. Preferably, the device and method are used in a liquid-conveying machine, particularly, a washing machine and/or a dishwasher. Particularly, light is introduced into the light-guiding body to detect the presence of the deposits. The light is internally reflected by the surface and is guided to a sensor. If deposits occur on the surface, the deposits affect the light-reflecting properties of the surface, and the affect is detected by the sensor.

28 Claims, 4 Drawing Sheets

DEVICE FOR DETECTING DEPOSITS ON SURFACES, IN PARTICULAR, IN WASHING MACHINES AND/OR DISHWASHERS

CROSS-REFERENCE TO RELATED APPLICATION

This application is a continuation of copending International Application No. PCT/EP00/00874, filed Feb. 3, 2000, which designated the United States.

BACKGROUND OF THE INVENTION

FIELD OF THE INVENTION

The invention lies in the field of appliances. The invention relates to a device for detecting deposits on surfaces, in particular, in liquid-conveying machines such as washing machines and/or dishwashers. Such machines include, therefore, all machines where deposits, in particular, lime deposits, can occur on surfaces. By measuring such a risk of deposits, a measure directed against the deposits is provided, or at least information on such a state is provided.

The invention is described below with regard to dishwashers and/or washing machines as an example of a water-conveying machine. In dishwashers and/or washing machines (hereinafter collectively referred to as "dishwashers" for clarity), it is possible for deposits to occur on the dishes to be cleaned.

Such deposits are particularly disagreeable, especially on glass surfaces. The deposits mostly occur as scaling and arise when the water used for cleaning is not adequately descaled, when auxiliaries added to the water and intended to avoid scaling do not act sufficiently or are not present, or when ion exchangers are not used early enough or renewed in good time. Such instances of scaling strike the user only when they are serious. It is, therefore, desirable to detect the traces of scaling very early before they are "obvious" to enable taking appropriate steps that avoid further deposits.

In principle, it is possible to determine the lime content of the rinsing water itself and to use these measurements as a basis for concluding how scaling possibly occurs. Thus, there exist dishwashers that use expensive chemical sensors to detect the lime content of the water and, for example, to activate an ion exchanger in the event of an excessively high lime content.

SUMMARY OF THE INVENTION

It is accordingly an object of the invention to provide a device for detecting deposits on surfaces, in particular, in liquid-conveying machines such as washing machines and/or dishwashers that overcomes the hereinafore-mentioned disadvantages of the heretofore-known devices and methods of this general type and that is compact, insensitive to interference, and detects deposits at an early state.

With the foregoing and other objects in view, there is provided, in accordance with the invention, a device for detecting deposits on surfaces, including at least one body having a surface on which deposits occur and influence reflection properties of the surface to electromagnetic radiation, at least one transmitter for transmitting electromagnetic radiation to the at least one body, the at least one transmitter being connected to the at least one body, and at least one detector for detecting the presence of the deposits at the surface, the at least one detector being connected to the at least one body and measuring electromagnetic radiation received from the at least one transmitter after reflection at the surface.

Instances of scaling or the like particularly come into consideration as the deposits mentioned.

In addition, it is to be possible for the device not only to be used in novel washing machines and/or dishwashers constructed for using the invention but also to be retrofitted in machines already in operation.

The device generates, as a function of the detected deposits, signals that are fed to a controller to initiate steps that avoid further deposits or reduce those present.

In accordance with another feature of the invention, the transmitter introduces the electromagnetic radiation into the body and the electromagnetic radiation reaches the detector after internal reflection at the surface.

In accordance with a further feature of the invention, the electromagnetic radiation reaches the detector after multiple internal reflections in the body.

In accordance with an added feature of the invention, the transmitter emits electromagnetic radiation at a predetermined wavelength dependent on a degree of change in electromagnetic radiation reflection properties by the deposits on the surface. The predetermined wavelength is selected to correspond to a maximum degree of change in electromagnetic radiation reflection properties.

In accordance with an additional feature of the invention, there are provided two detectors disposed with respect to the transmitter to create paths of the electromagnetic radiation from the transmitter to the two detectors and the paths have different lengths inside the body.

In accordance with yet another feature of the invention, there are provided two transmitters disposed with respect to the detector to create paths of the electromagnetic radiation from the two transmitters to the detector and the paths have different lengths inside the body.

In accordance with yet a further feature of the invention, the body has a point at which the electromagnetic radiation is introduced at the body and another point at which the electromagnetic radiation reaches the detector, and the point and the another point are adjacent to one another.

In accordance with yet an added feature of the invention, the body has a silvered surface for reflecting the electromagnetic radiation and an inside, and the silvered surface directed toward the inside of the body and substantially reflects the electromagnetic radiation for guiding the electromagnetic radiation to the detector.

In accordance with yet an additional feature of the invention, the body is a light-guiding body, and the electromagnetic radiation propagates inside the light-guiding body on a helical and/or coiled path.

In accordance with again another feature of the invention, the body is made of a material having a refractive index greater than a refractive index of a medium surrounding the body. Preferably, the medium is water and the material is glass.

In accordance with again a further feature of the invention, there are provided a connecting piece, and a sensor part having the body and being detachably connected to the connecting piece.

In accordance with again an added feature of the invention, the body one of spiral-shaped, coiled, and reel-shaped.

In accordance with again an additional feature of the invention, the transmitter introduces the electromagnetic radiation into the body at an angle maximizing a number of internal reflections of the electromagnetic radiation at the surface.

In accordance with still another feature of the invention, the body has a central axis, and the transmitter introduces the electromagnetic radiation into the body in a beam inclined at an angle relative to the central axis. Preferably, the beam has a minimum amount of divergence.

In accordance with still an added feature of the invention, the surface of the body is disposed in a liquid-conveying machine, particularly a washing machine and/or dishwasher.

With the objects of the invention in view, there is also provided a method for detecting deposits on surfaces including the steps of transmitting electromagnetic radiation from transmitter, reflecting the electromagnetic radiation at a surface of a body on which exist deposits influencing reflection properties for the electromagnetic radiation, and detecting the reflected electromagnetic radiation with at least one detector. Preferably, the steps are performed in a liquid-conveying machine, particularly, a washing machine and/or a dishwasher.

In accordance with still an additional mode of the invention, a transmitter transmits the electromagnetic radiation, the electromagnetic radiation is reflected at a surface of a body on which exist deposits influencing reflection properties for the electromagnetic radiation, and at least one detector detects the reflected electromagnetic radiation.

In accordance with a concomitant mode of the invention, the electromagnetic radiation is introduced into the body and the electromagnetic radiation is detected after internal reflection on the surface of the body.

Other features that are considered as characteristic for the invention are set forth in the appended claims.

Although the invention is illustrated and described herein as embodied in a device for detecting deposits on surfaces, in particular, in liquid-conveying machines such as washing machines and/or dishwashers, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
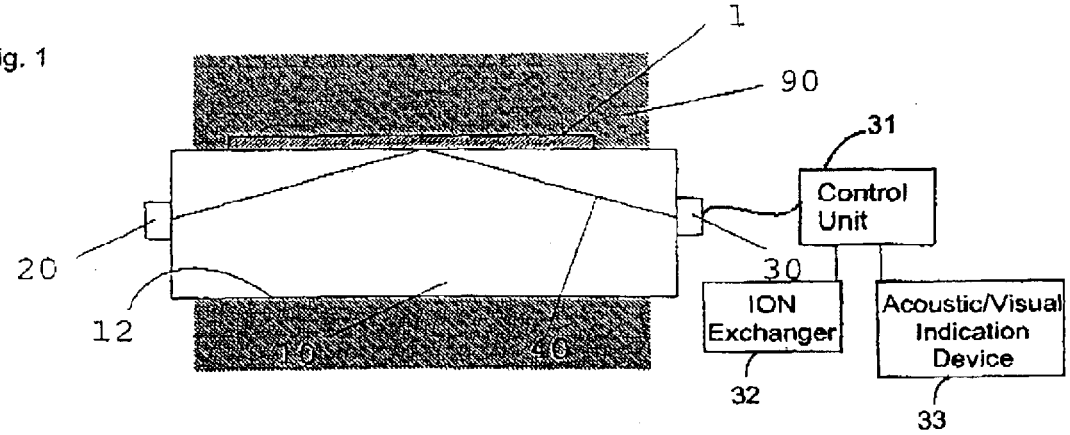
FIG. 1 is a diagrammatic elevational view of a device for detecting deposits in a washing machine or dishwasher according to the invention.

In all the figures of the drawing, sub-features and integral parts that correspond to one another bear the same reference symbol in each case.

Referring now to the figures of the drawings in detail and first, particularly to FIG. 1 thereof, there is shown, fitted in a dishwasher and/or washing machine, a light-guiding body 10 into which light is introduced such that it propagates inside the body 10 on a predetermined beam path 40, and is reflected internally in the process on an outer surface 12 of the body 10. The deposits to be detected 1 can occur on the outside of the outer surface 12. Such reflection is denoted below as "internal reflection" because the light used for measurement is propagated and/or reflected only inside the body 10. After internal reflection, a detector 30 receives the light. If deposits 1 occur on the outer surface 12 on the body 10, they influence the light reflection properties of the surface 12. As a result, the signal level of the internally reflected light changes by comparison with the signal level of the originally introduced light. Consequently, the light detected after internal reflection, or its signal level, is measured as a measure of deposits 1 on the body 10. If the measurement exceeds a predetermined limiting value, the detector 30 or a control unit 31 connected thereto generates signals that are fed to devices to avoid further deposits 1 or to reduce existing deposits 1. Such devices can include, for example, devices that feed auxiliaries (for example, for ion exchangers 32), and/or devices 33 that inform the user, either optically and/or acoustically, that excessively thick deposits 1 have occurred. These devices, which become active in the event of excessively thick deposits 1, are preferably connected directly to the dishwasher or are integrated therein.

A control unit 31 undertakes a calibration of the measuring device at the start and/or at the end of each operating process of the dishwasher because the device according to the invention is intended to detect deposits 1 that arise during a rinsing and/or washing operation. The calibration takes account of deposits 1 on the body 10 that are already present before a rinsing and/or washing operation. Moreover, with calibration, a check can be made to determine whether or not deposits 1 already present on the body 10 are so thick that they must be removed to ensure reliable operation of a device according to the invention. Moreover, such a check makes possible the ability to derive a trend for the occurrence of deposits from the history of a plurality of past washing operations. Such calibration can be performed for a transmitter 20, the detector 30, or for both in a process carried out separately or jointly.

In addition, the control unit can control the transmitter 20 and the detector 30 such that deposits 1 can be detected not only continuously but also in time intervals that are predetermined as a function of the respective application.

Preferably, a material for the light-guiding body 10 is selected to have a refractive index n higher than that of the liquid 90 surrounding the body 10. In conventional household washing machines, the liquid 90 is water, but it can be any other liquid used for cleaning, depending on the type of washing machine. In the case of water, it is preferred to select a refractive index n of higher than 1.33. Furthermore, the body 10 preferably has a surface 12 that has, with regard to the occurrence of deposits, properties that are identical or at least comparable to those of the surface of glassware to be cleaned in the machine.

Preferably, light is used to detect deposits. However, it is also possible to use any type of electromagnetic radiation.

A basic principle of the invention is realized in the embodiment shown in FIG. 1. Other modified embodiments are described below.

One possible variant is the use of differently shaped bodies 10. In principle, any arbitrarily shaped light-guiding body 10 that guides radiation from a transmitter 20 to at least one point of internal reflection and thereafter to a detector 30 is suitable. For example, cuboidal, spherical, hemispherical, cylindrical, or annular bodies 10, or combinations of such shaped bodies 10 are possible. It is possible, moreover, to use bodies 10 made from a flexible light-guiding material.

The selection of the respective body shape is determined principally by the desired number of internal reflections of radiation on its path from the transmitter 20 to a detector 30. To ensure the highest possible number of internal reflections, a cylindrical body 10 is selected for the embodiments illustrated below. FIGS. 2 to 7 show such cylindrical bodies in various embodiments.

Furthermore, the beam paths 40, 42, 44 in the body 10 can differ not only in different embodiments, but also in one embodiment. See, i.e., FIGS. 4 to 8. The beam paths 40, 42, 44 are situated such that internal reflections are distributed on the surface of the body, and it is possible to detect lime deposits with the aid of a measurement based on multiple reflections.

A beam path 40, 42, 44 in the body 10 is determined by introducing the radiation into the body 10. In the case of a cylindrical body 10, the radiation is not introduced parallel to the longitudinal axis of the body 10, but at an angle thereto. The number of internal reflections can be predetermined as a function of the angle, at least two, preferably at least three or five or, even further, particularly, at least seven internal reflections being provided here. See FIG. 2. Moreover, it is to be preferred that a helical (coiled) beam path 40, 42, 44 results (see FIG. 3). The numbers mentioned here of internal reflections are to be understood merely by way of example, and not as limiting the invention because the aim is to maximize the number of internal reflections as a function of the various applications of the invention to detect deposits more sensitively and more accurately.

Figure 2:
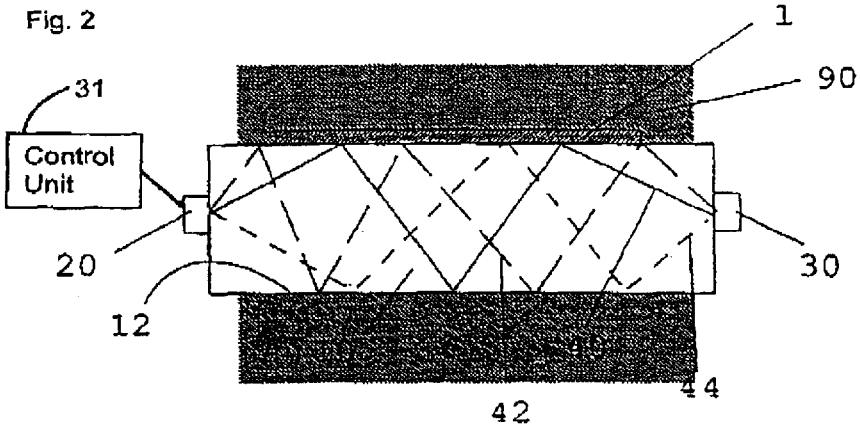
FIG. 2 is a cross-sectional view of the device according to FIG. 1 showing multiple internal reflections.
Figure 3:
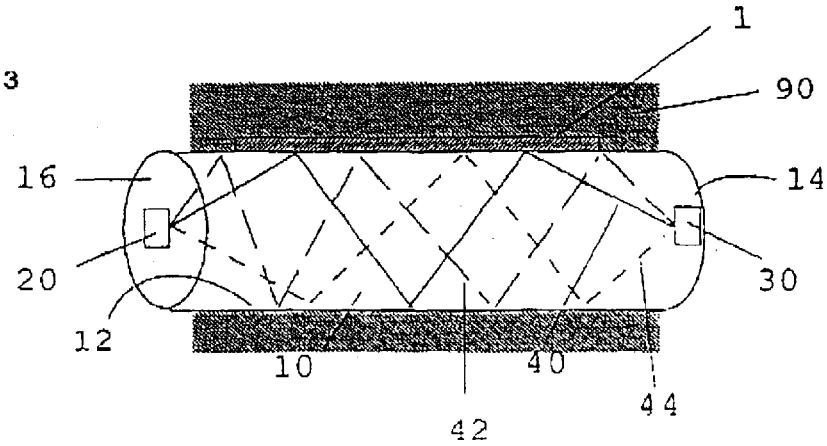
FIG. 3 is a perspective view of a device according to the invention having a cylindrical body and multiple internal reflections in a helical beam path.
Figure 4:
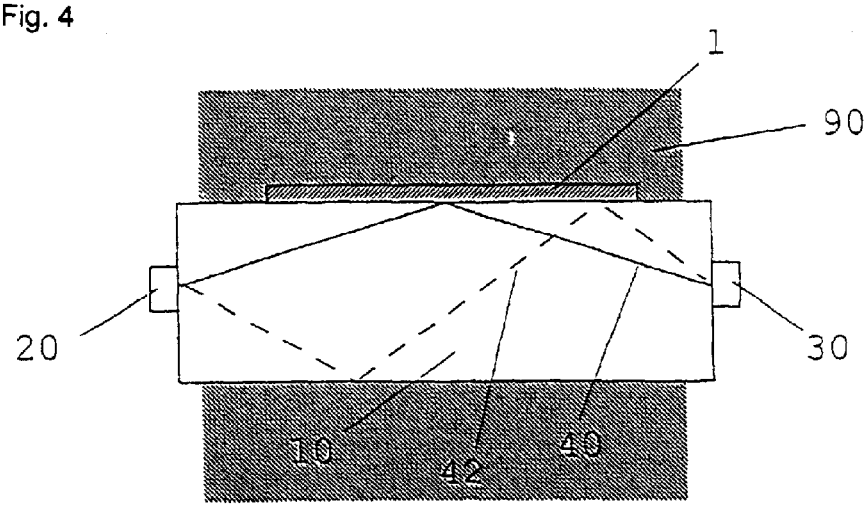
FIG. 4 is a cross-sectional view of the device according to FIG. 1 with various beam paths.
Figure 5:
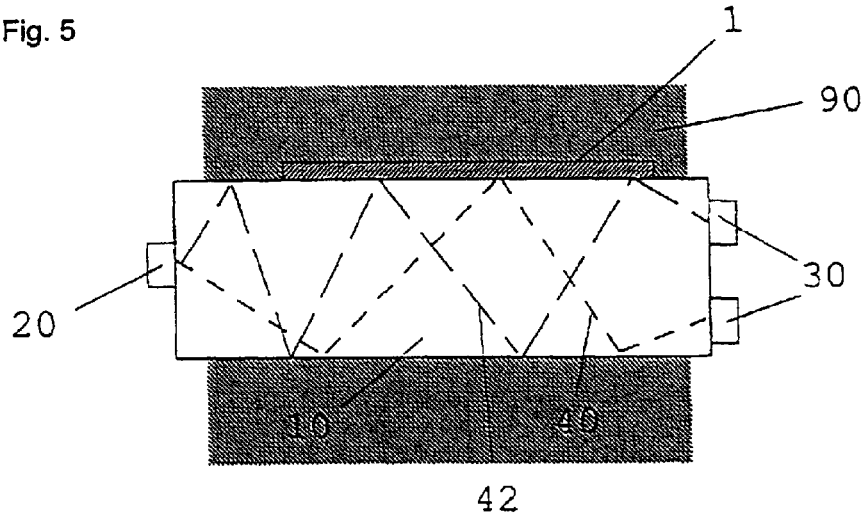
FIG. 5 is a cross-sectional view of the device according to FIG. 1 with various beam paths when using a transmitter and two detectors.
Figure 6:
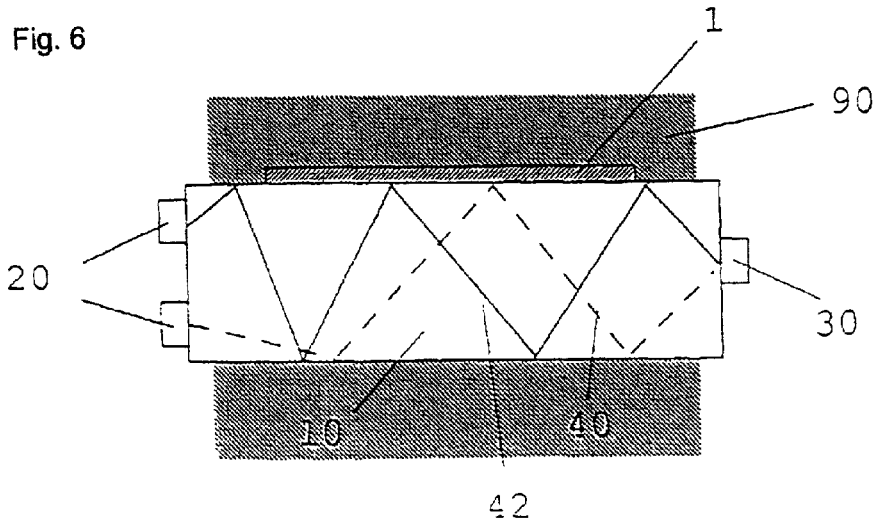
FIG. 6 is a cross-sectional view of the device according to FIG. 1 with various beam paths when using two transmitters and one detector.
Figure 7:
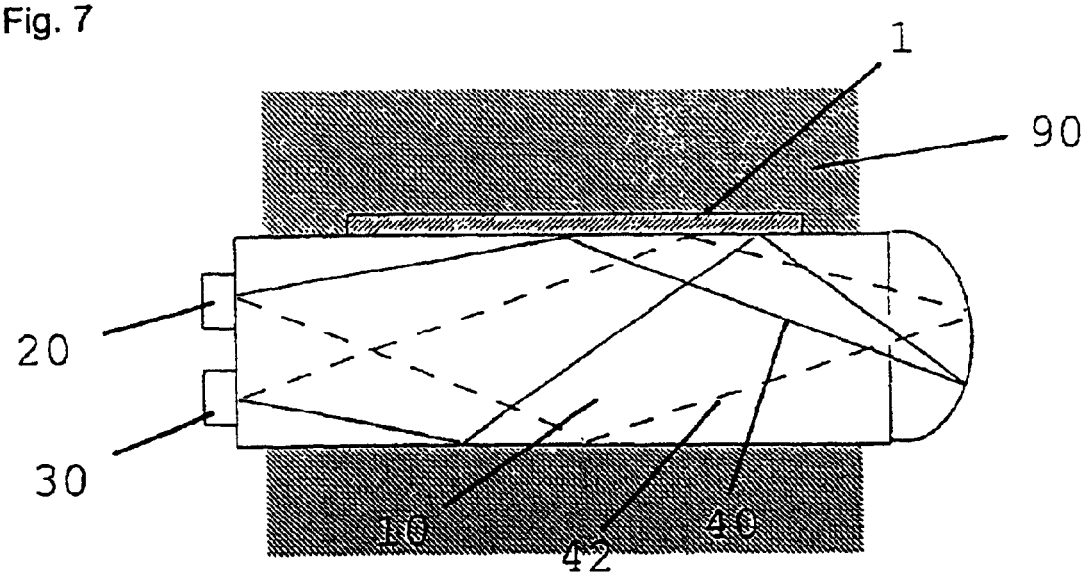
FIG. 7 is a cross-sectional view of the device according to the FIG. 1 with helical beam paths in a cylindrical body having a retroflecting dome.
Figure 8:
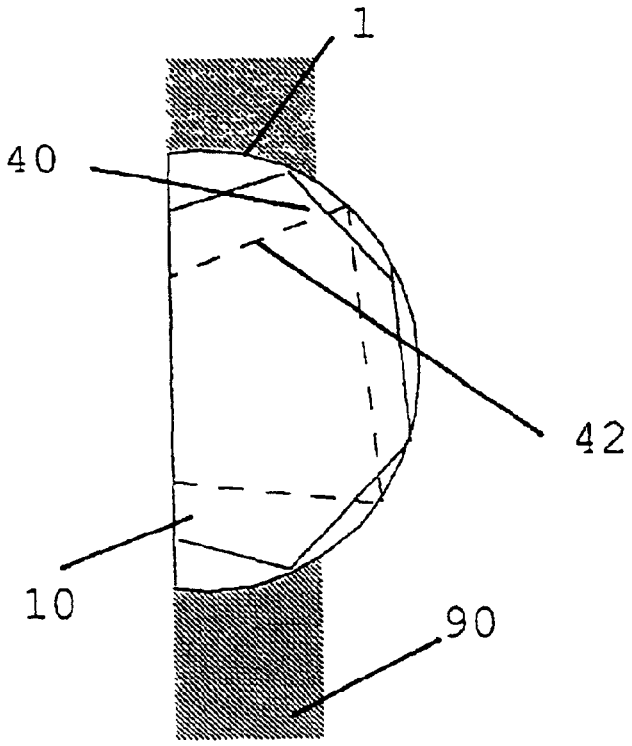
FIG. 8 is a cross-sectional view of the retroflecting dome of FIG. 7.

As is shown in FIGS. 2 and 3, the radiation can be irradiated into the body 10 in different directions (three directions are illustrated). In such a case, radiation is introduced into the body 10 such that it propagates in the body 10 on different paths 40, 42, 44. The paths 40, 42, 44 differ in the number of reflections occurring in the course of the individual paths and/or in their length. See FIG. 4. The variance can be achieved, for example, by different leads of the helicies of the radiation or by a selection of different points at which radiation is introduced.

With the aid of a selective detection 30, 32 of the radiation, it is possible to form a ratio of the signal level of the radiation propagating on different paths 40, 42, 44. As a result, it is possible to eliminate from the measurement influences acting on the signal levels that are not caused by lime deposits. Such influences include, for example, aging of the transmitters 20, 22 and different deposits 1 being located at various points of the body 10. The selective detection 30, 32 can be achieved in different ways. Thus, the radiation propagating on different paths 40, 42, 44 can be detected at different points of the body 10 by a corresponding detector 30 respectively. See FIG. 5. It is also possible for the radiation propagating on different paths 40, 42, 44 to be coupled out at identical points of the body 10, and to be detected with a detector 30. See FIG. 6. In such a case, it is necessary to ensure a unique assignment of the detected radiation to the corresponding beam paths 40, 42, 44 by other measures such as, for example, by using pulsed radiation or radiation of different wavelength. Depending on specific requirements placed on a device according to the invention, it can be advantageous to combine different embodiments of a selective detection.

In accordance with FIG. 3, a cylindrical body 10 has a reflecting end 14 and an end 16 that is opposite the reflecting end and at which radiation is introduced and removed.

The reflecting end 14 can be internally silvered, as a result of which reflection properties at the reflecting end 14 are not influenced by deposits 1 on the body 10. It is preferred for internal reflections to take place at the reflecting end 14 due to an appropriate shaping of the body 10. Thus, in one embodiment, the reflecting end 14 is configured as a hemispherical dome 14 on the body 10 (see FIG. 7), it being possible, however, in principle to use any desired shaped reflecting end 14 that guides radiation through the body 10 to the detector 30. The shape of the reflecting end 14 can be formed, for example, by one and/or more planar and/or curved surfaces. The configuration is also achieved by selecting the shape of the overall body 10 in a suitable way, for example, as an annular or hemispherical body. See FIG. 8.

It is also possible to introduce the radiation into the body 10 after it has been generated by a transmitter 20 by using beam-guiding devices, for example, beam-guiding fibers or other optical components. Likewise, the radiation can be lead to the detector by using such beam-guiding devices. It is also possible to introduce radiation from a transmitter 20 at different points of the body 10 and/or to remove radiation at different points of the body 10 and feed it to one or more detectors 30.

Figure 9:
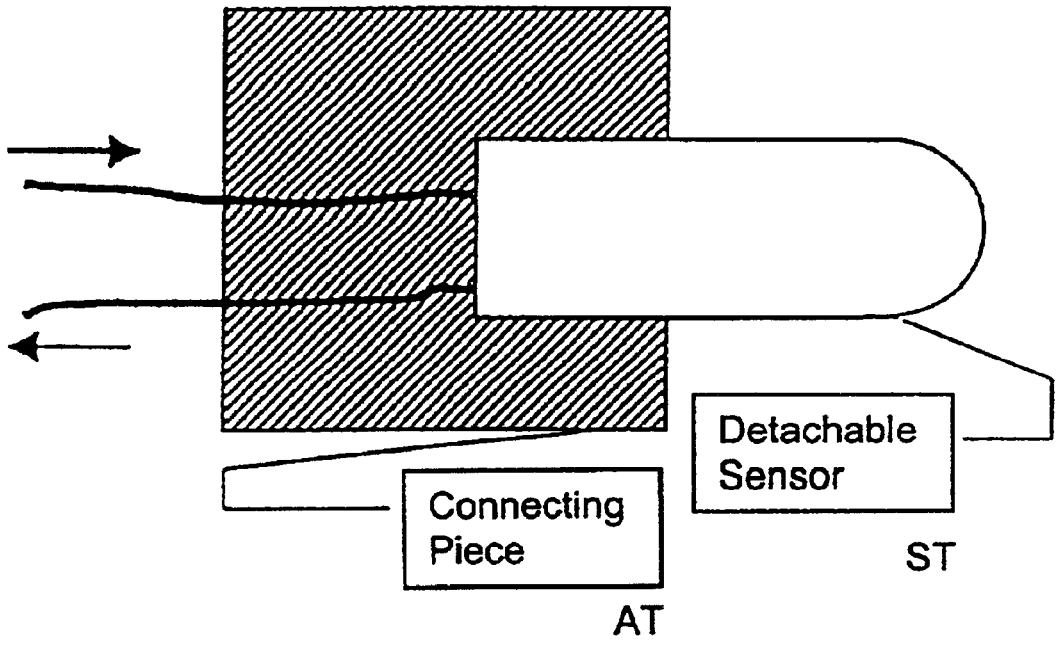
FIG. 9 is a diagrammatic cross-sectional illustration of a sensor and connector according to the invention.

In another preferred embodiment of the invention shown in FIG. 9, the device for detecting deposits has a bipartite configuration. A connecting piece AT is located in the interior of a dishwasher. At least the part of the device according to the invention that is exposed to the deposits, for example, scaling, is detachably connected for the purpose of exchange with the connecting piece AT. The detachably connected part of the device according to the invention is denoted below as sensor part ST. In addition to the required devices for detachably connecting to the connecting piece AT, the sensor part ST preferably includes the body 10 but can also include the sensor 20 and/or the detector 30. The connecting piece AT permits signals required for measuring the deposits to be fed into the sensor part ST, and permits the required signals to be discharged from the sensor ST. The type of signals depends on the respective configuration of the sensor part ST. If the sensor part ST includes the body 10, but not the transmitter 20 and the detector 30, these signals will be electromagnetic radiation. In contrast, these signals are electric signals when the sensor part ST also has the transmitter 20 and detector 30. The signals output by the connecting piece AT can be generated in the connecting piece AT itself, or be fed to the connecting piece AT from additional devices. In a comparable way, signals that the connecting piece AT receive from the sensor part ST can be at least preprocessed in the connecting piece AT and then relayed to further devices, or transmitted directly to other devices for evaluating the measuring signals.

It is, therefore, possible for the sensor part ST to be exchanged easily, for example, in the case of damage or contamination. Moreover, sensor parts ST can be used whose elements (surfaces) on which deposits are formed have different shapes and/or are made of different materials. Such construction permits the device according to the invention to be adapted to specific applications to be able to identify as exactly as possible various types of deposits on different bodies.

The bodies 10 are described only schematically in the figures of the drawings can also have a different shape, in particular, they can be arcuate, spiral-shaped, coiled, or reel-shaped, with the light being introduced into the body at one end and being removed or measured at another end. It is possible with the aid of such bodies, to maximize the number of the internal reflections of the tightly focused beam, which therefore, diverges as little as possible. Over a hundred internal reflections are possible. As such, the measuring signal can indicate possible lime deposits sensitively.

We claim:

1. A device for controlling deposits on surfaces, comprising:

at least one body having two opposite longitudinal end surfaces and a surface on an outside of said body on which deposits occur and influence reflection properties of said surface to electromagnetic radiation inside said body;

at least one transmitter for transmitting electromagnetic radiation to said at least one body and reflecting the electromagnetic radiation off said surface inside said body, said at least one, transmitter disposed at one of said opposite longitudinal end surfaces and being connected to said at least one body;

at least one detector for detecting a presence of the deposits at said surface, said at least one detector disposed at one of said opposite longitudinal end surfaces and being connected to said at least one body and measuring electromagnetic radiation received from said at least one transmitter after reflection at said surface, said at least one detector generating signals based upon the presence of deposits detected at said surface; and at least one ion exchanger connected to said detector for controlling the deposits at said surface, said at least one ion exchanger controlling the deposits in dependence on the signals generated by said at least one detector.

2. The device according to claim 1, wherein said at least one transmitter introduces the electromagnetic radiation into said at least one body and the electromagnetic radiation reaches said at least one detector after internal reflection at said surface.

3. The device according to claim 2, wherein the electromagnetic radiation reaches said at least one detector after multiple internal reflections in said at least one body.

4. The device according to claim 1, wherein said at least one transmitter emits electromagnetic radiation at a predetermined wavelength dependent on a degree of change in electromagnetic radiation reflection properties by the deposits on said surface.

5. The device according to claim 4, wherein said predetermined wavelength is selected to correspond to a maximum degree of change in electromagnetic radiation reflection properties by the deposits on said surface.

6. The device according to claim 1, wherein said at least one detector is two detectors disposed with respect to said at least one transmitter to create paths of the electromagnetic radiation from said at least one transmitter to said two detectors having different lengths inside said at least one body.

7. The device according to claim 1, wherein said at least one transmitter is two transmitters disposed with respect to said at least one detector to create paths of the electromagnetic radiation from said two transmitters to said at least one detector having different lengths inside said at least one body.

8. The device according to claim 1, wherein said at least one body has a point at which the electromagnetic radiation is introduced at said at least one body and another point at which the electromagnetic radiation reaches said at least one detector, and said point and said another point are adjacent to one another.

9. The device according to claim 8, wherein:

said at least one body has a silvered surface for reflecting the electromagnetic radiation and an inside; and said silvered surface directed toward said inside of said at least one body and substantially reflects the electromagnetic radiation for guiding the electromagnetic radiation to said at least one detector.

10. The device according to claim 7, wherein:

said at least one body is a light-guiding body; and the electromagnetic radiation propagates inside said light-guiding body.

11. The device according to claim 1, wherein said at least one body is made of a material having a refractive index greater than a refractive index of a medium surrounding said at least one body.

12. The device according to claim 11, wherein said medium is water.

13. The device according to claim 11, wherein said material is glass.

14. The device according to claim 1, including:

a connecting piece; and a sensor part baying said at least one body and being detachably connected to said connecting piece.

15. The device according to claim 1, wherein said at least one transmitter introduces the electromagnetic radiation into said at least one body at an angle maximizing a number of internal reflections of the electromagnetic radiation at said surface.

16. The device according to claim 1, wherein:

said at least one body has a central axis; and said at least one transmitter introduces the electromagnetic radiation into said at least one body in a beam inclined at an angle relative to said central axis.

17. The device according to claim 16, wherein said beam has a minimum amount of divergence.

18. The device according to claim 1, wherein said surface of said at least one body is disposed in a liquid-conveying machine.

19. The device according to claim 1, wherein said surface of said at least one body is disposed in a washing machine.

20. The device according to claim 1, wherein said surface of said at least one body is disposed in a dishwasher.

21. The device according to claim 1, further comprising a control unit receiving the signals generated by said detector, said control unit controlling said ion exchanger.

22. The device according to claim 1, wherein said ion exchanger visually indicates that excessively thick deposits have occurred.

23. The device according to claim 1, wherein said ion exchanger acoustically indicates that excessively thick deposits have occurred.

24. A method for controlling deposits on surfaces, which comprises:

providing at least one body having two opposite longitudinal end surfaces and a surface on an outside of the body on which deposits occur and influence reflection properties of the surface to electromagnetic radiation inside the body;

providing at least one transmitter at one of the opposite longitudinal end surfaces and connecting the transmitter to the at least one body;

providing at least one detector at one of the opposite longitudinal end surfaces and connecting the detector to the at least one body;

transmitting electromagnetic radiation from the at least one transmitter to the at least one body;

reflecting the electromagnetic radiation off the inside surface of the body on which deposits occur influencing reflection properties for the electromagnetic radiation;

detecting the reflected electromagnetic radiation with the at least one detector;

generating signals with the detector based upon the deposits at the surface of the body; and controlling the deposit at the surface with an ion exchanger in dependence on receipt of the signals generated by the at least one detector.

25. The method according to claim 24, which further comprises:

introducing the electromagnetic radiation into the body; and detecting the electromagnetic radiation after internal reflection on the surface of the body.

26. The method according to claim 24, which further comprises performing the transmitting, reflecting, and detecting Steps in a liquid-conveying machine.

27. The method according to claim 24, which further comprises performing the transmitting, reflecting, and detecting steps in a washing machine.

28. The method according to claim 24, which further comprises performing the transmitting, reflecting, and detecting steps in a dishwasher.

* * * * *